US011786062B1

(12) United States Patent
Lehtonen

(10) Patent No.: US 11,786,062 B1
(45) Date of Patent: Oct. 17, 2023

(54) SUPPORT SYSTEM FOR A FASHION ARTICLE

(71) Applicant: NO SACRIFICE BAGS INC., King (CA)

(72) Inventor: Donna Lee Elizabeth Lehtonen, Schomberg (CA)

(73) Assignee: NO SACRIFICE BAGS, INC., Ontario (CA)

( * ) Notice: Subject to any disclaimer, the term of this patent is extended or adjusted under 35 U.S.C. 154(b) by 0 days.

(21) Appl. No.: 18/094,837

(22) Filed: Jan. 9, 2023

(51) Int. Cl.
*A47G 25/14* (2006.01)
*A45C 13/00* (2006.01)

(52) U.S. Cl.
CPC ..... *A47G 25/14* (2013.01); *A45C 13/002* (2013.01)

(58) Field of Classification Search
CPC ..... A47G 25/00–60; A47G 25/1407–1478; A47G 25/4076; A47G 25/183; A47G 25/186; A47G 2025/1486; A47G 2025/1492; A45C 13/00; A45C 13/002
See application file for complete search history.

(56) References Cited

U.S. PATENT DOCUMENTS 1,815,673 A * 7/1931 Kelley ..... A47G 25/485 294/143
2,064,133 A 12/1936 Schroeder
2,265,789 A * 12/1941 Vivaudou ..... A47G 25/60 223/86
2,532,255 A 11/1950 Davis
3,860,210 A 1/1975 Berardinelli et al.
4,118,001 A 10/1978 Serkez
5,664,712 A 9/1997 Smrt
6,345,418 B1 * 2/2002 Bertrand ..... B65D 63/16 24/199
7,644,900 B2 1/2010 Yap et al.
8,925,740 B1 * 1/2015 Fanok ..... A47F 7/08 211/119.004
9,463,752 B1 10/2016 Lehtonen
9,756,917 B2 9/2017 Zech et al.
(Continued)

FOREIGN PATENT DOCUMENTS

WO WO-2013142825 A1 * 9/2013 ..... A45C 11/008

OTHER PUBLICATIONS

No Sacrifice Bags Store on Amazon, "UnderCovers Dust Cover with Purseport ID Tag, Purse Protector for Designer Bags (Available in Small and Medium)", Date first available: Jun. 21, 2018, https://www.amazon.com/UnderCovers-Purseport-Protector-Designer-Available/dp/B07DX6KHYH?ref_=ast_sto_dp.

*Primary Examiner* — Ismael Izaguirre
(74) *Attorney, Agent, or Firm* — Kintner IP, LLC; Mary Frances Ludwig

(57) ABSTRACT

A support system for a fashion article cooperates with a clothing hanger for storing purses, jewelry, garments, or similar. The support system allows storage of multiple fashion articles on a single hanger. The support system includes a support strap attachable to the hanger and a protective cover attachable to the support strap. The support strap may include multiple fasteners, and may be configured to support a purse by the handle in a manner that resists damage to the handle. The protective cover may provide access to contents stored therein without removing the cover from the system. Aspects of the system may store purses and other articles in a configuration which requires relatively little storage space.

20 Claims, 6 Drawing Sheets

(56) References Cited

U.S. PATENT DOCUMENTS

| | | | | |
|---|---|---|---|---|
| 9,930,985 | B2 | 4/2018 | Daring | |
| 10,869,569 | B2 | 12/2020 | Lehtonen | |
| 2004/0206868 | A1 | 10/2004 | Kaufman | |
| 2005/0161570 | A1 | 7/2005 | Bauerly et al. | |
| 2008/0035687 | A1* | 2/2008 | Beaulieu | B60R 7/08 224/275 |
| 2008/0054139 | A1 | 3/2008 | Fabbri | |
| 2011/0248057 | A1* | 10/2011 | Schmitz | A45C 13/30 294/142 |
| 2014/0048187 | A1 | 2/2014 | Marquez-Bottome | |
| 2015/0021369 | A1* | 1/2015 | Lehtonen | B60R 7/043 224/275 |
| 2015/0060501 | A1* | 3/2015 | Trusiak | A47G 25/485 223/91 |

* cited by examiner

SUPPORT SYSTEM FOR A FASHION ARTICLE

CROSS REFERENCE TO RELATED APPLICATION

None

TECHNICAL FIELD

The present invention pertains generally to devices for holding and/or covering personal items, and more particularly to a support strap and a protective cover for purses and other fashion articles.

BACKGROUND OF THE INVENTION

Purses and handbags are a convenient method for people to carry and transport personal items. Purses can range in style and in value. Often, individuals have a collection of purses each serving a different purpose or having a specific style to match an outfit or occasion. Many purses can be expensive and/or may be made of delicate material, thus, keeping them in pristine condition is very important for both aesthetic purposes and resale purposes.

Purses made of delicate materials, such as velvet, may be damaged if the purse is stored laying down. It is therefore desirable to store a purse by hanging it from a purse hook or similar device. Conventional purse hooks pose several problems. Purse hooks are often configured so that the purse hangs perpendicular to the hook. When these hooks are used on a garment hanging bar, such as in a closet, the purse hangs orthogonal to the direction of the garments and takes up a significant amount of space. Further, conventional purse hooks often have a thin dowel-shaped or rectangular-shaped surface that makes contact with the handles of the purse. The thin profile of such a hook may cause the purse handles to bend over the hook in a narrow arc, which can cause the handles to break and/or stretch, thereby becoming deformed.

Protective covers for purses and other fashion articles often require that the covered article be removed from a storage system before taking the cover off, making it challenging for a user to remember where to replace the article within an organized storage system. Conventional covers and storage systems also often hide their contents from view, requiring the user to remove and open multiple covers to find a desired article.

Therefore, a need exists for a purse support that provides proper support to purse handles and orients the purse in a direction that takes as little space as possible while being stored. There is also a need for a protective cover that allows a covered item to be removed from a storage system without displacing the cover.

BRIEF SUMMARY OF THE EMBODIMENTS

Embodiments disclosed herein are directed to a support system for a fashion article which cooperates with a clothing hanger and may be used to store purses or handbags, jewelry, garments, or the like in a compact and organized manner, thereby reducing the storage space commonly required for such articles. The support system may allow multiple coordinated fashion articles to be stored together on a single hanger (e.g., shoes, a handbag, jewelry, a belt, and hosiery that a user desires to wear together may be stored using one or more support straps on a single hanger). The support system may include one or more protective covers, such as a flexible bag. The protective cover may be supported on a support strap, and may protect the fashion articles contained therein from light (e.g., UV light) and dust, which can be particularly detrimental to leather and fabric purses. The protective cover provides an alternative way to store a purse with the support system, and supports the body of the purse rather than hanging the purse by its handles. The system is easy to use and portable for traveling.

According to one or more embodiments, a support system for a fashion article cooperates with a hanger having a crossbar. The support system includes:

a support strap including:

a substantially rectangular-shaped support strap body having an outer surface, an inner surface, a top edge, a bottom edge, a right side edge and a left side edge;

a first fastener located on the support strap body and having a first fastener piece and a second fastener piece configured for engagement with the first fastener piece;

wherein the support strap is attachable to the hanger by folding the support strap body over the crossbar so that the inner surface of the support strap body is in contact with the crossbar, and engaging the first fastener piece with the second fastener piece with the support strap extending downward from the crossbar; and a second fastener located on the support strap body and having a third fastener piece and a fourth fastener piece configured for engagement with the third fastener piece;

a flexible bag having an access opening shaped to receive the fashion article, a closure substantially surrounding the access opening, and an aperture adjacent the closure; and wherein the support strap is attachable to the flexible bag by passing the support strap body through the aperture so that the inner surface of the support strap body is in contact with the bag, and engaging the third fastener piece with the fourth fastener piece so that the support strap encircles the closure.

According to one or more embodiments, the flexible bag is structurally configured to conceal the fashion article while being attached to the support strap. In some embodiments, the flexible bag includes an identification tag for marking with names of the stored articles.

According to one or more embodiments, the flexible bag is structurally configured for removal or insertion of the fashion article through the access opening while the flexible bag is attached to the support strap. This feature allows the user to access articles contained within the flexible bag without removing the support strap from the hanger, thereby maintaining the organization of the system.

According to one or more embodiments, the aperture is shaped and dimensioned to receive the support strap therethrough.

According to one or more embodiments, the support strap is attachable to the hanger so that both the third fastener piece and the fourth fastener piece are positioned below the crossbar.

According to one or more embodiments, the support strap body is structurally configured to support the flexible bag and distribute pressure along a predetermined length of the aperture.

According to one or more embodiments, a support strap for a purse having a handle cooperates with a hanger having a crossbar. The support strap includes:

a substantially rectangular-shaped support strap body having an outer surface, an inner surface, a top edge, a bottom edge, a right side edge and a left side edge;

a first fastener located on the support strap body and including a first fastener piece and a second fastener piece configured for engagement with the first fastener piece;

wherein the support strap is attachable to the hanger by folding the support strap body over the crossbar so that the inner surface of the support strap body is in contact with the crossbar, and engaging the first fastener piece with the second fastener piece with the support strap extending downward from the crossbar;

a second fastener located on the support strap body and including a third fastener piece and a fourth fastener piece configured for engagement with the third fastener piece; and wherein the support strap is attachable to the handle of the purse by folding the support strap body over the handle so that the inner surface of the support strap body is in contact with the handle, and engaging the third fastener piece with the fourth fastener piece.

According to one or more embodiments, the first fastener extends substantially orthogonal to a major dimension of the support strap body.

According to one or more embodiments, both of the first fastener piece and the second fastener piece are located on the inner surface of the support strap body.

According to one or more embodiments, the first fastener piece is spaced apart from the second fastener piece and both the first fastener piece and the second fastener piece are offset from both the top edge and the bottom edge.

According to one or more embodiments, the support strap is attachable to the hanger so that both the third fastener piece and the fourth fastener piece are positioned below the crossbar.

According to one or more embodiments, the support strap body is structurally configured to support the purse handle and distribute pressure along a predetermined length of the purse handle. This feature provides gentle treatment of the purse handles and resists damage from supporting the weight of the purse over an extended time.

According to one or more embodiments, the support strap body includes a notch intermediate the second fastener piece and the fourth fastener piece. This feature may reduce bunching of the support strap material in the area the strap contacts the purse handle.

According to one or more embodiments, the first fastener piece is located on the inner surface of the support strap body, and the third fastener piece is located on the outer surface of the support strap body and substantially opposite the first fastener piece.

According to one or more embodiments, the second fastener extends substantially orthogonal to a major dimension of the support strap body.

According to one or more embodiments, the third fastener piece is located on the outer surface of the support strap body and the fourth fastener piece is located on the inner surface of the support strap body.

According to one or more embodiments, the third fastener piece is located adjacent the top edge of the support strap body.

According to one or more embodiments, the fourth fastener piece is located adjacent the bottom edge of the support strap body.

According to one or more embodiments, the first fastener is a hook and loop fastener.

According to one or more embodiments, the second fastener is a hook and loop fastener.

These and other aspects of the embodiments will be better appreciated and understood when considered in conjunction with the following description and the accompanying drawings. The following description, while indicating various embodiments and details thereof, is given by way of illustration and not of limitation. Many substitutions, modifications, additions, or rearrangements may be made within the scope of the embodiments, and the embodiments may include all such substitutions, modifications, additions, or rearrangements.

BRIEF DESCRIPTION OF THE DRAWINGS

Non-limiting and non-exhaustive embodiments of the support system for a fashion article are described with reference to the following figures, wherein like reference numerals refer to like parts throughout the various views unless otherwise specified.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. Also, common but well-understood elements that are useful or necessary in a commercially feasible embodiment are often not depicted in order to facilitate a less obstructed view of these various embodiments.

DETAILED DESCRIPTION OF THE INVENTION

The detailed description describes non-limiting exemplary embodiments. Any individual features may be combined with other features as required by different applications for at least the benefits described herein. As used herein, the term "about" means plus or minus 10% of a given value unless specifically indicated otherwise. As used herein, the term "substantially the same" means that two items are at least 90% the same.

As used herein, the conjunction "or" is to be construed inclusively (e.g., "A or B" would be interpreted as "A, or B, or both A and B"; e.g., "A, B, or C" would be interpreted as "A; or B; or C; or any two of A, B, and C; or all three of A, B, and C").

As used herein, disclosure of a singular element is also a disclosure of a plural element and vice versa unless otherwise noted.

The support system for fashion articles includes a support strap and, in some embodiments, includes a protective cover such as a flexible bag. While particular embodiments may be described with reference to purses or handbags, it will be understood that the support system may be used in a similar manner with many different types of fashion articles. For example, the support system may be used with accessories, such as jewelry or belts; garments, such as hosiery, scarves, or ties; footwear; headwear; or the like.

The support strap may be used in cooperation with a hanger, such as a conventional clothes hanger having a crossbar. The support strap may also, or instead, be used in a similar manner in cooperation with a hook, a peg, a closet bar, a door knob, a retail display, or similar device.

Figure 1:
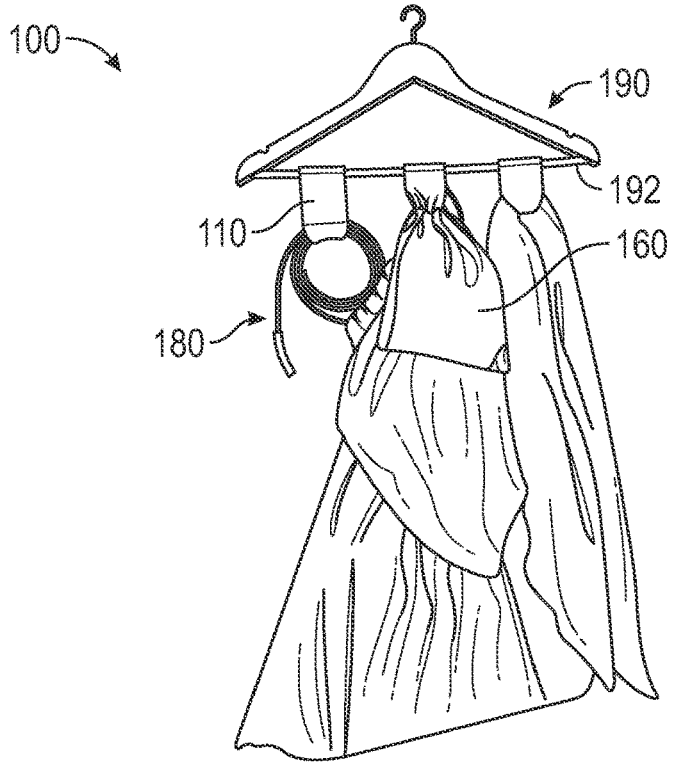
FIG. 1 is a front view of a support system for a fashion article, in accordance with a representative embodiment.

FIG. 1 illustrates a front view of a support system 100 for a fashion article 180, in accordance with a representative embodiment. Support system 100 is depicted in use with a cooperating hanger 190. Hanger 190 includes a crossbar 192, and a support strap 110 of support system 100 is shown attached to hanger 190 by folding the support strap over the crossbar. The system may include more than one support strap attached to the same hanger. The shown embodiment includes three of support strap 110, each folded over crossbar 192. In this manner, a user of the system may organize several fashion articles, for example a coordinating belt, scarf, shoes and handbag, by grouping them on a single hanger, which simplifies putting together a fashion outfit or "look".

A flexible bag 160 provides a protective cover for a fashion article. Flexible bag 160 may be attached to a support strap 110. In this way, the system may support articles that are otherwise difficult to hang, such as shoes. Support strap 110 may support more than one flexible bag 160 (see middle support strap 110 shown supporting three of flexible bag 160). Multiple bags may be arranged in a cascading size progression (e.g., smallest bag in the front with progressively larger bags toward the rear); this arrangement requires relatively little storage space, and provides easy access and an organized visual appearance.

Figure 2:
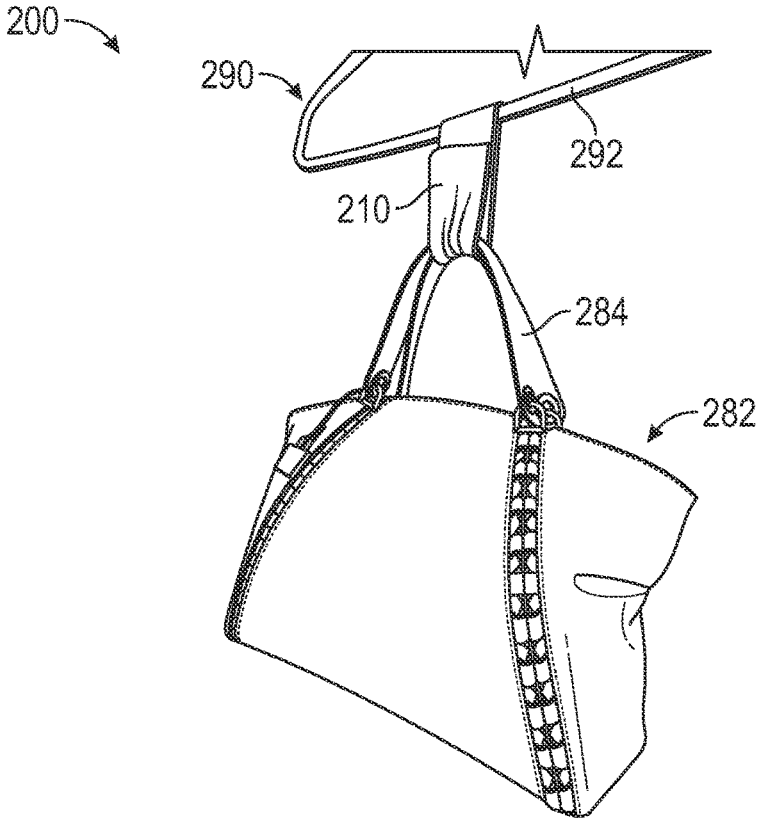
FIG. 2 is a perspective view of the support system, in accordance with a representative embodiment.

FIG. 2 is a perspective view of an embodiment of a support system 200. Support system 200 includes a support strap 210 attached to a crossbar 292 of a hanger 290. Support strap 210 is attached to a handle 284 of a purse 282, thereby supporting the purse by the handle. Support strap 210 includes a support strap body which may be a piece of flexible material, such as suede, linen, cotton, or another type of fabric. The support strap body generally has a width designed to support a purse handle in a manner that distributes the weight of the purse over a predetermined length of the purse handle, such as a length sufficient to resist wear or prevent damage to the purse handle. For example, the support strap body may have a width similar to the width of a user's hand. Such a support strap body would be structurally configured to support the purse handle and distribute pressure along a predetermined length of the purse handle substantially equivalent to the width of a hand. A protective cover, such as flexible bag 160 of system 100 (see FIG. 1), may optionally be used with support system 200.

Figure 3:
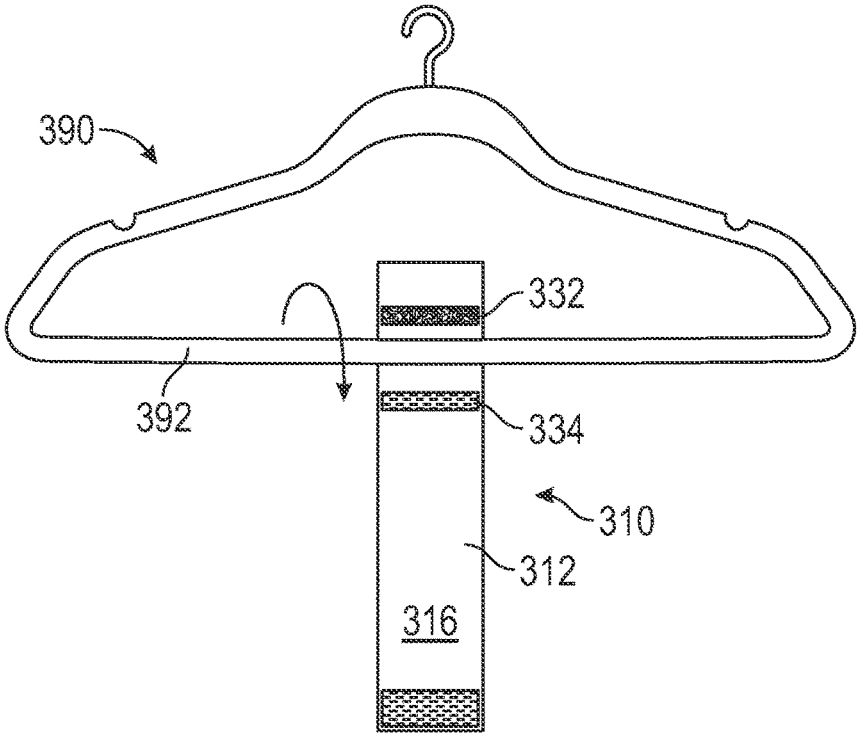
FIG. 3 is a front view of a support strap, in accordance with a representative embodiment.
Figure 4:
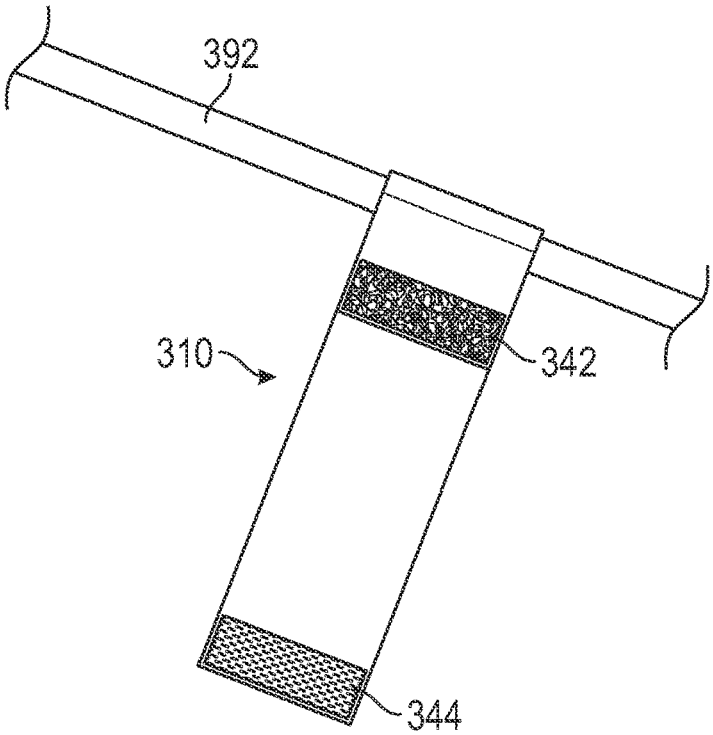
FIG. 4 is a front view of the support strap in a position of use, in accordance with a representative embodiment.

FIGS. 3 & 4 are front views of an embodiment of a support strap 310, in various positions of use with a cooperating hanger 390. Support strap 310 includes a first fastener located on support strap body 312. The first fastener includes a first fastener piece 332 and a second fastener piece 334. The first fastener piece and second fastener piece are configured for engagement with one another, and may be, for example, complementary pieces of a hook and loop fastener, a snap-fit type fastener, a magnetic fastener, a button and a button-hole, or similar. Support strap 310 is attachable to hanger 390 by folding support strap body 312 over crossbar 392, as illustrated by the directional arrow of FIG. 3. In this way, an inner surface 316 of the support strap body is in contact with crossbar 392. First fastener piece 332 may be engaged with second fastener piece 334 to attach the support strap to the hanger, with the support strap extending downwardly from the crossbar of the hanger.

Support strap 310 also includes a second fastener located on support strap body 312. The second fastener includes a third fastener piece 342 and a fourth fastener piece 344. The third fastener piece and fourth fastener piece are configured for engagement with one another. The second fastener may be a fastener type substantially identical to, or similar to, the first fastener. In some embodiments, one or both of the first fastener and the second fastener are hook and loop fasteners. By folding support strap body 312 over a portion of a fashion article (such as handle 284 of purse 282 shown in FIG. 2), and engaging third fastener piece 342 with fourth fastener piece 344, support strap 310 is attachable to the fashion article. When attached this way, inner surface 316 of support strap body 312 is in contact with the purse handle or other fashion article, and the purse or other article is attached to the hanger and hanging below the crossbar. In the shown embodiment, both third fastener piece 342 and fourth fastener piece 344 are positioned below crossbar 392, and the second fastener, when engaged, is also positioned below the crossbar (as shown in FIG. 2). Support strap body 312 may be larger or smaller than depicted, as may be desired for specific applications. For example, by providing a shorter portion of support strap body 312 between second fastener piece 334 and fourth fastener piece 344, a small article may be held more securely by the support strap. In another example, by providing a longer portion of support strap body 312 between second fastener piece 334 and fourth fastener piece 344, a large article (e.g., a wide belt) may be held by the support strap.

FIGS. 5-10 are, respectively, front, rear, left side, right side, top, and bottom views of a support strap 510 for a fashion article, in accordance with a representative embodiment. Support strap body 512 has an outer surface 514, an inner surface 516, a top edge 518, a bottom edge 520, a right side edge 522, and a left side edge 524. Both of the first fastener (including first fastener piece 532 and second fastener piece 534) and the second fastener (including third fastener piece 542 and fourth fastener piece 544) extend substantially orthogonal to a major dimension of support strap body 512. In other embodiments, one or the other of the first fastener and the second fastener may be arranged on the support strap body in a different orientation.

In the shown embodiment, both of first fastener piece 532 and second fastener piece 534 are located on inner surface 516 of support strap body 512. First fastener piece 532 is spaced apart from second fastener piece 534, e.g., by a spacing sufficient to allow the support strap body to be wrapped around a hanger crossbar or similar device. First fastener piece 532 may be located adjacent top edge 518, or may be offset from both the top edge and the bottom edge (see FIG. 3). Second fastener piece 534 may be located offset from both top edge 518 and the bottom edge 520.

Regarding the second fastener, third fastener piece 542 may be located on outer surface 514 of support strap body 512, and fourth fastener piece 544 may be located on inner surface 516 of support strap body 512. As shown, third fastener piece 542 may be located adjacent top edge 518 of the support strap body and fourth fastener piece 544 may be located adjacent bottom edge 520 of the support strap body.

Support strap 510 has a substantially rectangular-shaped support strap body 512. In some embodiments, support strap body 512 may include a notch 528 intermediate second fastener piece 534 and fourth fastener piece 544. Two notches 528 are shown in the embodiment of FIGS. 5-10. These notches function to slightly reduce the support strap material in the area where the support strap contacts a purse handle, to reduce bunching of the strap. In a support strap including a notch it may be desirable to provide a width between two notches configured to support the purse handle in a manner that distributes the weight of the purse. A support strap with a notch may be considered to have a substantially rectangular-shaped support strap body.

Figure 5:
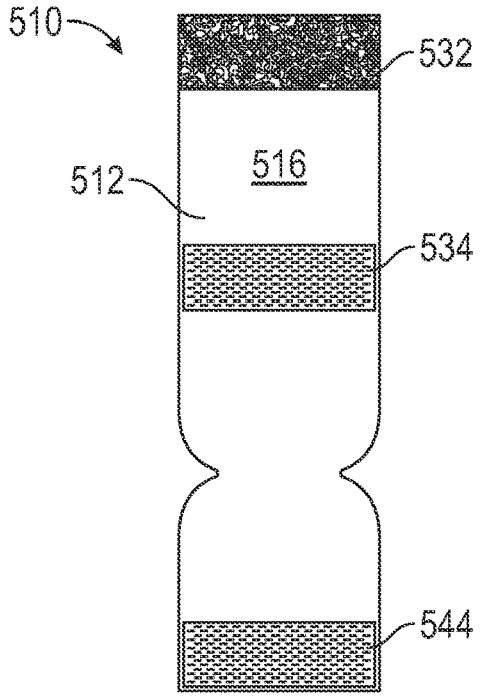
FIG. 5 is a front view of a support strap for a fashion article, in accordance with a representative embodiment.
Figure 6:
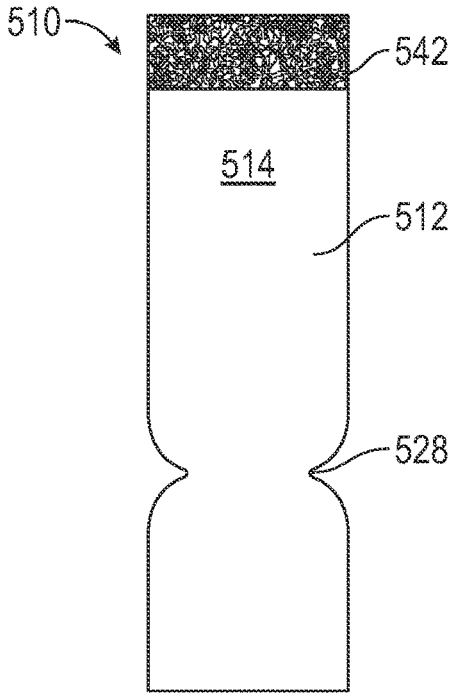
FIG. 6 is a rear view of the support strap of FIG. 5.
Figure 7:
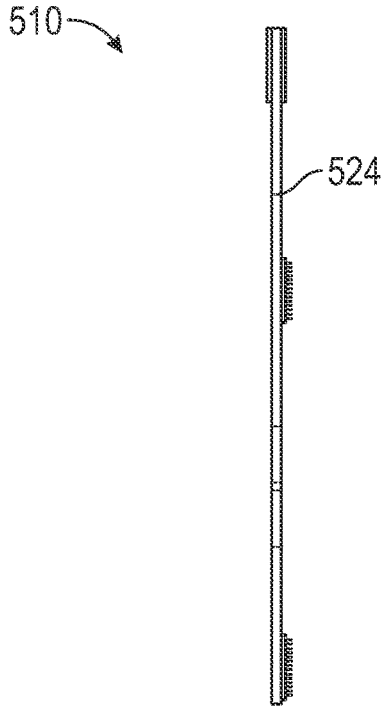
FIG. 7 is a left side view of the support strap of FIG. 5.
Figure 8:
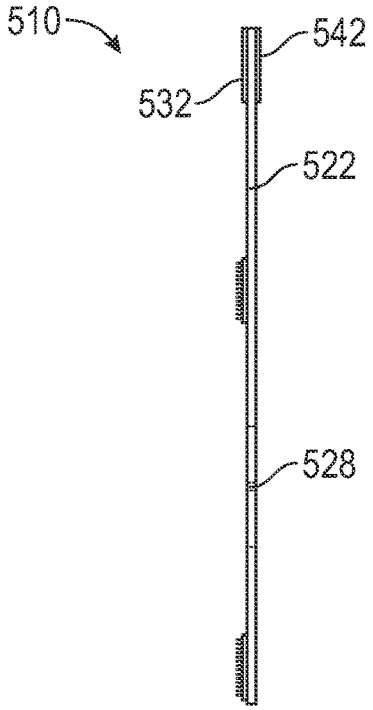
FIG. 8 is a right side view of the support strap of FIG. 5.
Figure 9:
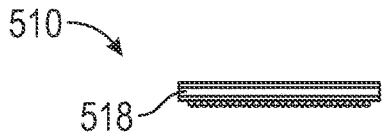
FIG. 9 is a top view of the support strap of FIG. 5.
Figure 10:
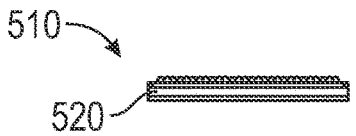
FIG. 10 is a bottom view of the support strap of FIG. 5.
Figure 11:
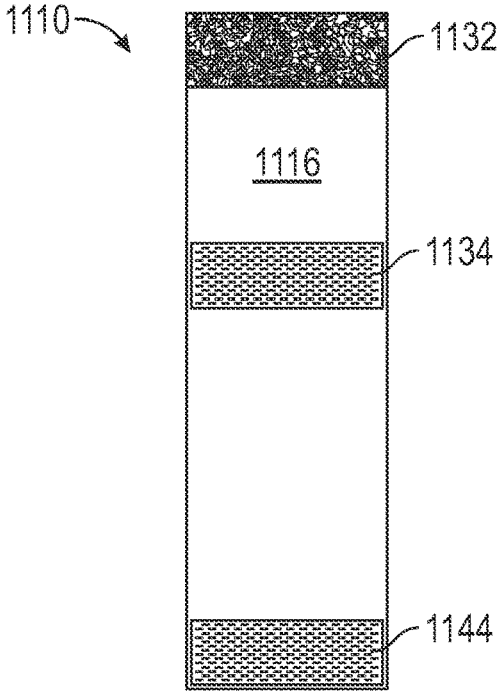
FIG. 11 is a front view of a support strap for a fashion article, in accordance with a representative embodiment.
Figure 12:
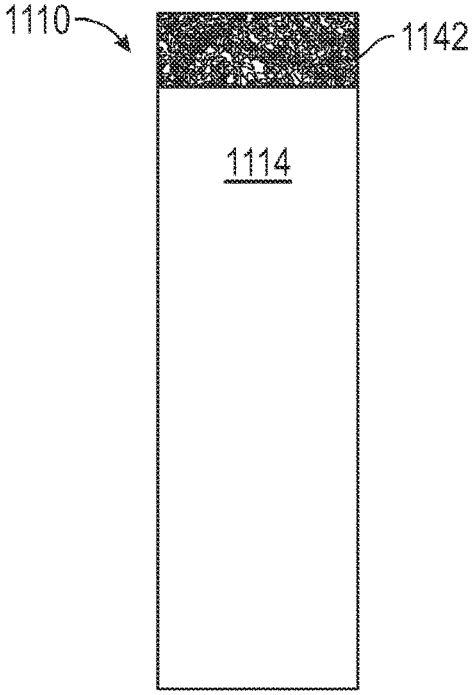
FIG. 12 is a rear view of the support strap of FIG. 11.
Figure 13:
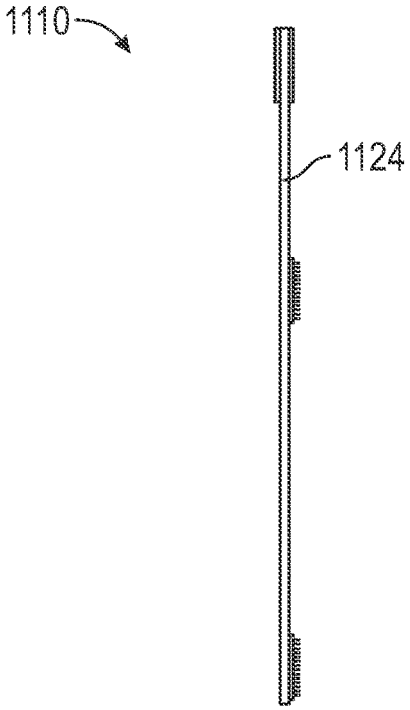
FIG. 13 is a left side view of the support strap of FIG. 11.
Figure 14:
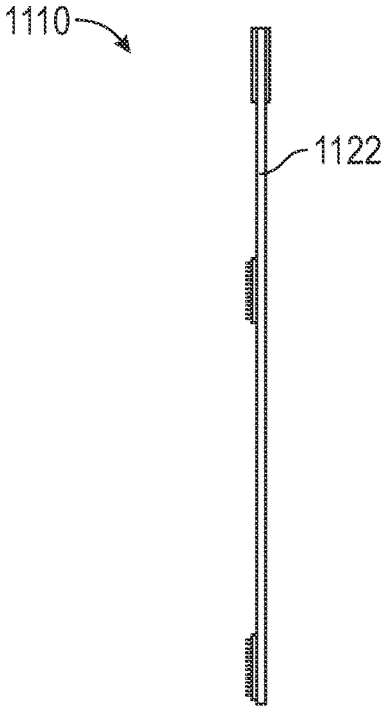
FIG. 14 is a right side view of the support strap of FIG. 11.
Figure 15:
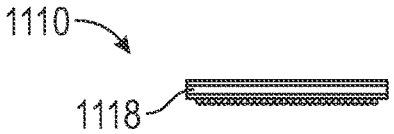
FIG. 15 is a top view of the support strap of FIG. 11.
Figure 16:
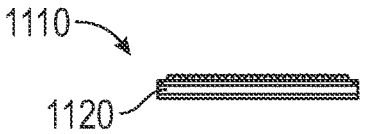
FIG. 16 is a bottom view of the support strap of FIG. 11.

As best seen in FIGS. 7 and 8, first fastener piece 532 may be located substantially opposite the third fastener piece 542. For example, first fastener piece 532 may be located on inner surface 516 of the support strap body and third fastener piece 542 may be located on outer surface 514 of the support strap body. In one case, both of first fastener piece 532 and third fastener piece 542 may have substantially the same offset distance relative to one or both of top edge 518 or bottom edge 520. In another case, a centerline of first fastener piece 532 and a centerline of third fastener piece 542 may have the same offset distance from either top edge 518 or bottom edge 520. In any of these embodiments, first fastener piece 532 and third fastener piece 542 may or may not have substantially the same size and shape (for example, FIGS. 5 & 6 show four fastener pieces having substantially the same size and shape, while FIGS. 3 & 4 show the first fastener having a different size and shape from the second fastener). The size, shape, and type of fastener may be selected for strength, ease of use, aesthetic purposes, or the like.

FIGS. 11-16 are, respectively, front, rear, left side, right side, top, and bottom views of a support strap 1110 for a fashion article, in accordance with a representative embodiment. The support strap body has an outer surface 1114, an inner surface 1116, a top edge 1118, a bottom edge 1120, a right side edge 1122, and a left side edge 1124. Both of the first fastener (including first fastener piece 1132 and second fastener piece 1134) and the second fastener (including third fastener piece 1142 and fourth fastener piece 1144) extend substantially orthogonal to a major dimension of the support strap body. In other embodiments, one or the other of the first fastener and the second fastener may be arranged on the support strap body in a different orientation. Features of support strap 1110 may have equivalent configuration or function as features described with respect to support strap 510 of FIGS. 5-10.

Regarding the embodiments of FIGS. 5-10 and FIGS. 11-16, while features of these embodiments are described in terms of function, such features may also contribute to the ornamental appearance of these embodiments. In one example embodiment, a design for the support strap as shown and described in FIGS. 5-10 is contemplated. In another example embodiment, a design for the support strap as shown and described in FIGS. 11-16 is contemplated. In another example embodiment, a design for the support strap as shown and described in FIGS. 5-10 is contemplated, wherein first fastener piece 532, second fastener piece 534, third fastener piece 542, and fourth fastener piece 544 form no part of the design. In another example embodiment, a design for the support strap as shown and described in FIGS. 11-16 is contemplated, wherein first fastener piece 1132, second fastener piece 1134, third fastener piece 1142, and fourth fastener piece 1144 form no part of the design. In other example embodiments, a design for the support strap as shown and described in either FIGS. 5-10 or FIGS. 11-16 may include a support strap body that is longer or shorter than depicted in the Figures. In other example embodiments, a design for the support strap as shown and described in either FIGS. 5-10 or FIGS. 11-16 may include the shape, configuration, or portions thereof of any of the first fastener piece, second fastener piece, third fastener piece, and fourth fastener piece.

Figure 17:
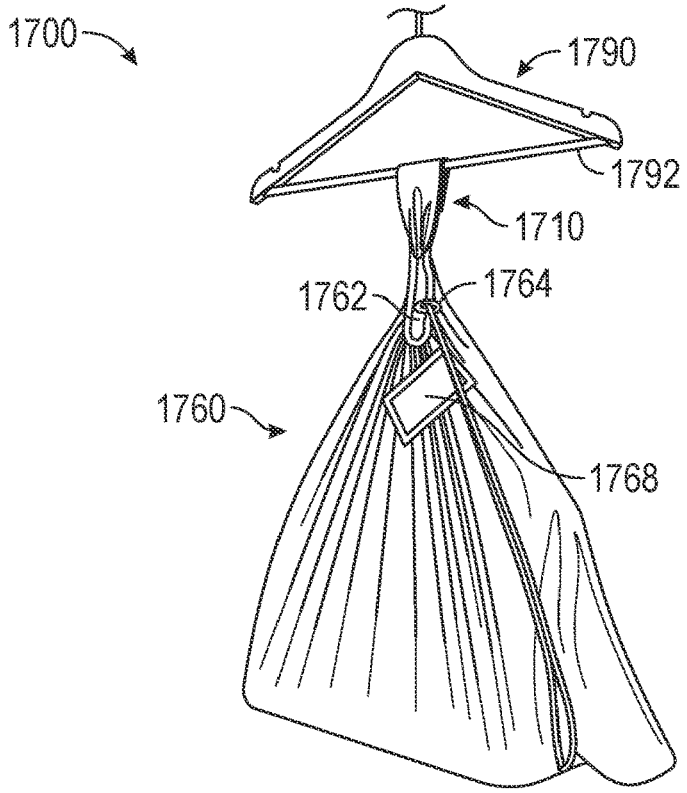
FIG. 17 is a perspective view of the support system, in accordance with a representative embodiment.

FIG. 17 is a perspective view of a support system 1700, in accordance with a representative embodiment. Support system 1700 includes a support strap 1710, which may be similar to embodiments of the support strap described above (e.g., support strap 510 of FIGS. 5-10). A flexible bag 1760 is shown attached to support strap 1710, and may be used to store and protect fashion articles, keeping such articles organized and reducing storage space requirements relative to conventional storage systems. Flexible bag 1760 may include an access opening 1762, a closure 1764, and an identification tag 1768. Access opening 1762 is shaped to receive a fashion article (e.g., a purse, shoes, a hat, etc.) for storage within the bag. Closure 1764 (e.g., a drawstring which may include a cord stop) substantially surrounds access opening 1762. Support strap 1710 is attachable to flexible bag 1760 by passing the support strap body through the aperture in the flexible bag (see aperture 1866 of FIG. 18). The inner surface of the support strap body is then in contact with, and may support, flexible bag 1760, in a manner similar to the support of a purse described herein. By wrapping support strap 1710 around crossbar 1792 of hanger 1790, and engaging the third fastener piece of the support strap with the fourth fastener piece of the support strap, the support strap may encircle a portion of closure 1766 and support flexible bag 1760 on hanger 1790. As shown, the flexible bag may hang substantially parallel to the crossbar of the hanger in a configuration which requires relatively little storage space. Identification tag 1768 optionally allows user to identify or label the contents of flexible bag 1760 without the need to open the bag.

Figure 18:
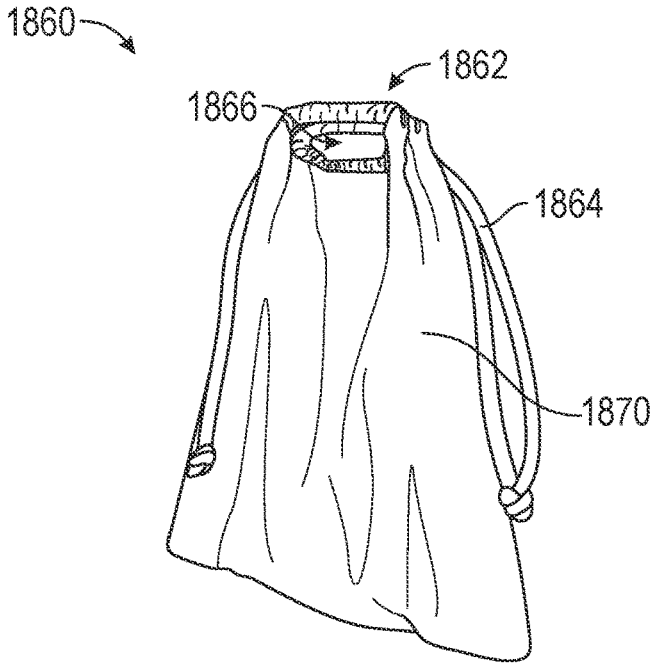
FIG. 18 a perspective view of a flexible bag, in accordance with a representative embodiment.

FIG. 18 a perspective view of an embodiment of a flexible bag 1860, including an access opening 1862, a closure 1864, and an aperture 1866. Aperture 1866 as shown in FIG. 18 is located in the sidewall 1870 of flexible bag 1860. Aperture 1866 is adjacent closure 1864, shown located below the closure, and may be shaped and dimensioned to receive a support strap therethrough (e.g., support strap 1710). Aperture 1866 may have a structure and appearance similar to a large buttonhole. One or more apertures may be present in various embodiments. For example, flexible bag 1860 includes two of aperture 1866, while flexible bag 1760 (FIG. 17) includes one aperture. By including a single aperture, or by attaching the support strap to only one aperture, the flexible bag may be structurally configured so that the bag may be opened or closed while attached to the support strap. This feature allows removal or insertion of a fashion article through the access opening while the flexible bag is attached to the support strap and/or the hanger. In preferred embodiments, the flexible bag may be made of a material such as linen, cotton flannel, natural fabric, sueded polyester, fabric having an anti-tarnish treatment, or other materials suitable for long term storage of purses, jewelry, and other delicate articles.

Figure 19:
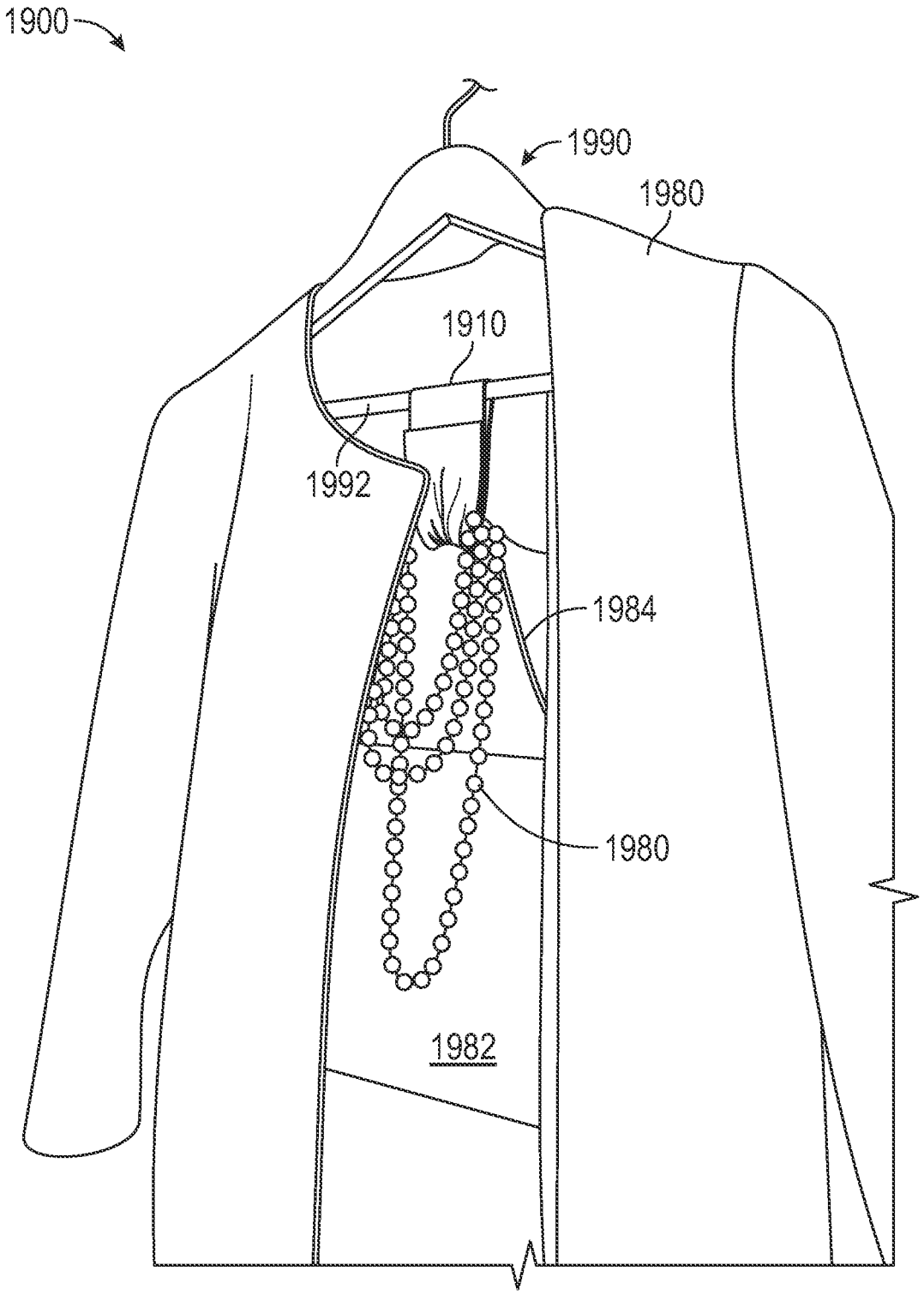
FIG. 19 is a perspective view of the support system, in accordance with a representative embodiment.

FIG. 19 is a perspective view of an embodiment of the support system 1900, including a support strap 1910 and a purse 1982 with a handle 1984. Support system 1900 is shown cooperating with a hanger 1990 having a crossbar 1992; and supporting several fashion articles 1980. Features of support system 1900 may be as described herein with reference to other embodiments. In the shown use configuration, several fashion articles (e.g., jewelry 1980 and purse 1982) are supported on hanger 1990 by support strap 1910. Another fashion article 1980, such as a coat or sweater, may also be supported on hanger 1990 in a manner which may conceal fashion articles attached to support strap 1910. This configuration allows a user to hide handbags or other valuable items from plain view, which may be desirable in a public setting.

Further provided is a support system, wherein a support strap and/or a protective cover (e.g., a flexible bag) is packaged with a hanger.

The embodiments of the support system for a fashion article described herein are exemplary and numerous modifications, combinations, variations, and rearrangements can be readily envisioned to achieve an equivalent result, all of which are intended to be embraced within the scope of the appended claims. Further, nothing in the above-provided discussions of the support system should be construed as limiting the invention to a particular embodiment or combination of embodiments. The scope of the invention is defined by the appended claims.

I claim:

1. A support system for a fashion article, the support system for cooperation with a hanger having a crossbar, the support system comprising:

a support strap including:

a substantially rectangular-shaped support strap body having an outer surface, an inner surface, a top edge, a bottom edge, a right side edge and a left side edge;

a first fastener located on the support strap body and having a first fastener piece and a second fastener piece configured for engagement with the first fastener piece;

wherein the support strap is attachable to the hanger by folding the support strap body over the crossbar so that the inner surface of the support strap body is in contact with the crossbar, and engaging the first fastener piece with the second fastener piece with the support strap extending downward from the crossbar; and a second fastener located on the support strap body and having a third fastener piece and a fourth fastener piece configured for engagement with the third fastener piece;

a flexible bag having an access opening shaped to receive the fashion article, a closure substantially surrounding the access opening, and an aperture in a sidewall of the flexible bag, the aperture located adjacent to and below the closure; and wherein the support strap is attachable to the flexible bag by passing the support strap body through the aperture so that the inner surface of the support strap body is in contact with the bag, and engaging the third fastener piece with the fourth fastener piece so that the support strap encircles the closure.

2. The support system of claim 1, wherein the flexible bag is structurally configured to conceal the fashion article while being attached to the support strap.

3. The support system of claim 1, wherein the flexible bag is structurally configured for removal or insertion of the fashion article through the access opening while the flexible bag is attached to the support strap.

4. The support system of claim 1, wherein the aperture is shaped and dimensioned to receive the support strap therethrough.

5. The support system of claim 1, wherein the support strap is attachable to the hanger so that both the third fastener piece and the fourth fastener piece are positioned below the crossbar.

6. The support system of claim 1, wherein the support strap body is structurally configured to support the flexible bag and distribute pressure along a predetermined length of the aperture.

7. A support strap for a purse having a handle, the support strap for cooperation with a hanger having a crossbar, the support strap comprising:

a substantially rectangular-shaped support strap body having an outer surface, an inner surface, a top edge, a bottom edge, a right side edge and a left side edge;

a first fastener located on the support strap body and including a first fastener piece and a second fastener piece configured for engagement with the first fastener piece;

wherein the support strap is attachable to the hanger by folding the support strap body over the crossbar so that the inner surface of the support strap body is in contact with the crossbar, and engaging the first fastener piece with the second fastener piece with the support strap extending downward from the crossbar;

a second fastener located on the support strap body and including a third fastener piece and a fourth fastener piece configured for engagement with the third fastener piece;

wherein both of the first fastener piece and the second fastener piece are located on the inner surface of the support strap body, the third fastener piece is located on the outer surface of the support strap body and substantially opposite the first fastener piece, so that engagement of the first fastener piece with the second fastener piece positions the third fastener piece for engagement with the fourth fastener piece; and wherein the support strap is attachable to the handle of the purse by folding the support strap body over the handle so that the inner surface of the support strap body is in contact with the handle, and engaging the third fastener piece with the fourth fastener piece.

8. The support strap of claim 7, wherein the first fastener extends substantially orthogonal to a major dimension of the support strap body.

9. The support strap of claim 7, wherein the support strap is attachable to the hanger so that both the third fastener piece and the fourth fastener piece are positioned below the crossbar.

10. The support strap of claim 7, wherein the support strap body is structurally configured to support the handle of the purse and distribute pressure along a predetermined length of the handle of the purse.

11. The support strap of claim 7, wherein the second fastener extends substantially orthogonal to a major dimension of the support strap body.

12. The support strap of claim 7, wherein the third fastener piece is located on the outer surface of the support strap body and the fourth fastener piece is located on the inner surface of the support strap body.

13. The support strap of claim 12, wherein the third fastener piece is located adjacent the top edge of the support strap body.

14. The support strap of claim 12, wherein the fourth fastener piece is located adjacent the bottom edge of the support strap body.

15. The support strap of claim 7, wherein the first fastener is a hook and loop fastener.

16. The support strap of claim 7, wherein the second fastener is a hook and loop fastener.

17. A support strap for a purse having a handle, the support strap for cooperation with a hanger having a crossbar, the support strap comprising:

a substantially rectangular-shaped support strap body having an outer surface, an inner surface, a top edge, a bottom edge, a right side edge and a left side edge;

a first fastener located on the support strap body and including a first fastener piece and a second fastener piece configured for engagement with the first fastener piece;

wherein the support strap is attachable to the hanger by folding the support strap body over the crossbar so that the inner surface of the support strap body is in contact with the crossbar, and engaging the first fastener piece with the second fastener piece with the support strap extending downward from the crossbar;

a second fastener located on the support strap body and including a third fastener piece and a fourth fastener piece configured for engagement with the third fastener piece;

wherein the support strap body includes a notch intermediate the second fastener piece and the fourth fastener piece; and wherein the support strap is attachable to the handle of the purse by folding the support strap body over the handle so that the inner surface of the support strap body is in contact with the handle, and engaging the third fastener piece with the fourth fastener piece.

18. The support strap of claim 17, wherein both of the first fastener piece and the second fastener piece are located on the inner surface of the support strap body.

19. The support strap of claim 18, wherein the first fastener piece is spaced apart from the second fastener piece and both the first fastener piece and the second fastener piece are offset from both the top edge and the bottom edge.

20. The support strap of claim 17, wherein the first fastener piece is located on the inner surface of the support strap body, and the third fastener piece is located on the outer surface of the support strap body and substantially opposite the first fastener piece.

* * * * *